United States Patent [19]

Mohr et al.

[11] 4,392,972

[45] Jul. 12, 1983

[54] ALUMINUM-CORROSION INHIBITIVE HEAT TRANSFER FLUID

[75] Inventors: Paul H. Mohr, Chappaqua; William N. Matulewicz, Montgomery, both of N.Y.

[73] Assignee: Union Carbide Corporation, Danbury, Conn.

[21] Appl. No.: 335,614

[22] Filed: Dec. 30, 1981

[51] Int. Cl.[3] ..... C23F 11/14; C23F 11/12

[52] U.S. Cl. ..... 252/75; 62/DIG. 20; 106/14.13; 106/14.14; 106/14.41; 106/14.44; 208/47; 252/68; 252/392; 252/396; 252/389 R; 422/13; 422/17; 422/16; 252/78.3

[58] Field of Search ..... 252/389 R, 392, 396, 252/25, 68, 78.3; 62/85, DIG. 20; 106/14.13, 14.14, 14.41, 14.44; 208/47; 422/13, 17, 16

[56] References Cited

U.S. PATENT DOCUMENTS

| | | | |
|---|---|---|---|
| 2,692,860 | 10/1954 | Barker | 252/75 |
| 3,418,354 | 12/1968 | Wheeler | 260/448.2 |
| 3,609,086 | 9/1969 | Modahl et al. | 62/DIG. 20 |
| 3,672,821 | 6/1972 | Schussler | 21/21.7 |
| 4,019,992 | 4/1977 | Krueger | 62/112 |
| 4,086,181 | 4/1978 | Suen et al. | 252/396 |
| 4,146,488 | 3/1979 | Martin | 252/34.7 |

*Primary Examiner*—Irwin Gluck

*Attorney, Agent, or Firm*—Dale Lynn Carlson

[57] ABSTRACT

Composition providing aluminum corrosion resistance comprising aqueous and/or alcohol solution of a polymerizable-acid graft copolymer consisting of a poly(oxyalkylene) compound grafted with an unsaturated acid, said graft copolymer having a percent graft of between about 1 and about 60 percent. Typical acids would be those selected from the group consisting of acrylic, methacrylic, crotonic and maleic acids.

34 Claims, No Drawings

ALUMINUM-CORROSION INHIBITIVE HEAT TRANSFER FLUID

BACKGROUND OF THE INVENTION

Acrylic acid grafted polymers are known in the art. By way of illustration, U.S. Pat. No. 4,146,488 discloses metal lubricant compositions containing poly(oxyalkylene) compounds grafted with about 3 to 15% by weight of acrylic or methacrylic acid followed by neutralization with alkanolamine. That patent discloses at column 7, lines 50 to 68 and column 8, lines 1 to 15, that such a polymer, when used in aqueous monoethanolamine borate solution is effective in providing cast iron corrosion resistance protection.

Heretofore, the effects of polymerizable-acid grafted polymers on aluminum surfaces have not been seen or explored in the literature. It has now been surprisingly found that aqueous and/or alcohol solutions of a certain class of such polymers have a particularly beneficial effect in inhibiting aluminum corrosion, most notably with respect to an aggressive form of aluminum corrosion, namely that which occurs at "heat rejecting" aluminum surfaces such as solar panels and the cylinder heads and blocks of internal combustion engines. This finding is particularly significant in view of the fact that there is increasing reliance on the use of aluminum components in the manufacture of heat transfer systems, such as those in solar and automotive systems, as part of an overall trend toward weight reduction.

OBJECT OF THE INVENTION

It is an object of the present invention to provide an aluminum corrosion inhibitor composition comprising an aqueous and/or alcohol solution of a polymerizable-acid graft copolymer, together with a method for using such composition.

This and other objects will become apparent from a reading of the following detailed specification.

SUMMARY OF THE INVENTION

In one aspect, the present invention relates to an aluminum corrosion inhibitor composition that is useful inter alia in heat transfer systems such as those found in solar and automotive systems. When used in an automobile, the composition can be added directly to the automobile coolant system via the radiator filler neck as is done with conventional antifreezes.

The composition of the present invention comprises:

(a) alcohol or mixtures of water and alcohol, (b) a polymerizable-acid graft copolymer comprising an unsaturated grafting acid (such as an acid selected from the group consisting of acrylic, methacrylic, crotonic and maleic acids) and having a percent acid graft of between about 1% and about 60% and a base polymer consisting of a poly(oxyalkylene) compound of the formula: $R''((OC_nH_{2n})_zOR')_a$ wherein R' and R'' are members selected from the group consisting of a hydrocarbon radical, a hydrogen atom or an acyl radical, a is an interger having a value of 1 to about 4, n has a value of 2 to 4 inclusive, z is an integer having a value of from 4 to 800 inclusive, and preferably 8 to about 500, said base polymer having a molecular weight of between about 200 and 10,000, and wherein the amount of component (b) is between greater than about 0.05 wt. % and about 20 wt. % (preferably from about 0.1 wt. % to about 15 wt. %), based on the total amount of component (a) plus component (b) in said concentrate. The composition preferably consists essentially of component (a) plus component (b).

In another aspect, the polymerizable-acid graft copolymer can, if desired, be partially or wholly neutralized with any base to provide a desired pH for the corrosion inhibitor composition. Such neutralization can take place before or after addition of the graft copolymer to the solution.

In yet another aspect, the invention encompasses methods for making the above composition, either by direct addition of the polymerizable acid grafted copolymers to water and/or alcohol or by adding the water and/or alcohol to the acid grafted copolymers or by pre-forming a composition concentrate. The corrosion inhibitor composition can be made from the composition concentrate by dilution of the concentrate with water and/or alcohol at the use site. In the concentrate, the amount of component (b) employed is between greater than about 0.05 wt. % and about 20 wt. % based on the total amount of component (a) plus component (b) in said composition.

DETAILED DESCRIPTION OF THE INVENTION

When component (a) of the above composition consists of a mixture of alcohol and water, such mixture can have a water to alcohol weight ratio ranging from 99:1 to 0:100.

The poly(alkylene oxide) compounds used to make the graft copolymers are known in the art. These are commonly produced by reacting an alkylene oxide or a mixture of alkylene oxides, added sequentially or in combination, with an alcohol. Such alcohols can be monohydric or polyhydric and correspond to the formula $R''(OH)_a$ wherein R'' and "a" are as defined above. Such alcohols include metnanol, ethanol, propanol, butanol, ethylene glycol, glycerol, the monoethylether of glycerol, the dimethyl ether of glycerol, sorbitol, 1,2,6-hexanetriol, trimethylolpropane, and the like.

Generally, the poly(oxyalkylene compounds used in this invention have molecular weights (number average) in the range of about 200 to about 10,000, preferably from 0 about 400 to about 5,000.

The grafting of the polymerizable-acid onto the poly(oxyalkylene) compounds can be carried out by free radical polymerization as is known in the art, to afford a grafted acid content of between about 1 and about 60 (preferably between about 5 and about 20).

Although useful grafting acids include, among others, acrylic, methacrylic, crotonic and maleic acids, preferred acids include acrylic and maleic acids, (more preferably acrylic acid).

The preferred poly(oxyalkylene) compounds useful in the present invention are the well-known poly(oxyethylene-oxypropylene) polymers, having a weight ratio of oxyethylene ("EO") to oxypropylene ("PO") of between 0:100 and 100:0.

As mentioned above, the acid graft copolymers useful in the present invention can, if desired, be conveniently partially or wholly neutralized to a desired pH base to provide the salt of the acid graft copolymer. Illustrative bases would include the following (although any known base can be used): ammonium hydroxide, alkali metal hydroxides, or alkaline earth metal hydroxides; or amines of the formula:

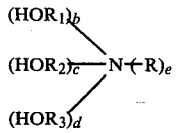

wherein R is hydrogen or alkyl having 1 to about 6 carbon atoms, each of $R_1$, $R_2$, and $R_3$ is an alkylene radical having 2 to 4 carbon atoms, e has a value of 0, 1, 2 or 3 and b, c, and d each have a value of 0 or 1, with the proviso that when b, c and d each have a value of 1, then e is 0.

When an alkanolamine is employed, the preferred alkanolamine is a trialkanolamine but mono- and dialkanolamines can also be used. The preferred trialkanolamine is triethanolamine although others, such as, trimethanolamine, methyldiethanolamine, tripropanolamine, diethylmonopropanol amine, tributanolamine, and the like, can also be used if desired. Exemplary monoalkanolamines include monoethanolamine, monopropanolamine, N-methyl ethanolamine, N,N-dimethyl ethanolamine, N,N-diethyl ethanolamine, and the like. Exemplary dialkanolamines include diethanolamine, dibutanolamine, N-methyl diethanolamine, N-ethyl ethanolamine, and the like.

Other useful amines include triethylamine, di-n-propylamine, tri-n-propylamine n-butylamine, n-amylamine, di-n-amylamine, n-hexylamine, ethylene diamine, propylene diamine, ethanolamine, diethanolamine, triethanolamine, cyclohexyl-amine, dicyclohexylamine, ethyl hexylamine, N-ethyl aniline, morpholine ethanol, 1-(N-methyl)-aminohexane-2,3,4,5,6-pentol, and mixtures of mono- and di-n-alkylamines. A commercial mixture of amyl amines consisting of about 60 percent mono-n-amylamine and about 40 percent di-n-amylamine can be used, although a wide variety of other commercial amines can suitably be employed.

Other optional additives may be employed in minor amounts of less than 50 wt. percent based on the weight of the aluminum corrosion inhibitor composition. Typical optional additives would include, for example, known corrosion inhibitors for aluminum or other metals in admixture with the polymerizable-acid graft copolymers of the present invention such as, for example, alkali metal, alkaline earth metal or alkanolamine salts of silicates, borates, phosphates and benzoates, hydroxy benzoates or acids thereof, silicones alkali metal nitrates, alkali metal nitrites, tolyltriazole, mercaptobenzothiazole, benzotriazole, and the like, or mixtures thereof. If one or more of the known inhibitors are employed together with the inhibitors of the present invention, the sum total of all inhibitors should be used in an "inhibitory effective amount", i.e., an amount sufficient to provide some corrosion inhibition with respect to the aluminum surfaces to be protected. Other typical optional additives would include wetting agents and surfactants such as, for example, known ionic and non-ionic surfactants such as the poly(oxyalkylene) adducts of fatty alcohols; antifoams and/or lubricants such as the well-known polysiloxanes and the polyoxyalkylene glycols, as well as any other minor ingredients known in the art that do not adversely affect the aluminum corrosion resistance sought to be achieved.

As used herein, the term "percent acid graft" designates such graft on a weight basis.

The following example is intended to illustrate, but in no way limit the present invention.

EXAMPLE 1

A. Preparation of Acid Graft Copolymers

An acid graft copolymer within the scope of the present invention was prepared using acrylic acid and a base polymer consisting of butanol started poly(oxyethylene-oxypropylene) copolymer having a molecular weight of 770 and a viscosity of 170 Saybolt seconds at 100° F. as follows:

Into a 5-liter, 3-neck round bottom flask fitted with a water condenser, thermocouple, stirrer, and means of introducing acrylic acid and catalyst, was placed 2700 gms of the polymer. By means of a heating mantle, the flask was heated to a temperature of 150° C., followed by the addition of 35 grams of tertiary-butyl perbenzoate and 312 grams of acrylic acid. The peroxide feed was begun 10 minutes prior to starting the acid feed and both ingredients were fed over a period of 90 minutes after which the product (herein called "Grafted Copolymer A") was allowed to cool to room temperature.

Several other acid grafted copolymers were prepared in accordance with the above procedure to provide Grafted Copolymers B, C, D, and E as listed in Table I below. The "% Graft" for the grafted copolymers of Table I was calculated on the basis of the total amount of grafting acid fed into the reaction mixture.

TABLE I

| Grafted Co-polymer | Grafting Acid | % Graft | Starter | Properties of Base Polymer: % EO/PO | Properties of Base Polymer: Molecular Wt. | Viscosity (Saybolt sec. at 100° F.) |
|---|---|---|---|---|---|---|
| A | acrylic | 10% | butanol | 50/50 | 770 | 170 |
| B | acrylic | 60% | butanol | 0/100 | 710 | 165 |
| C | acrylic | 5% | butanol | 0/100 | 2051 | 1145 |
| D | acrylic | 10% | butanol | 50/50 | 4000 | 5100 |
| E | acrylic | 15% | ethylene glycol | 100/0 | 8000 | solid |

The above acid grafted copolymers were individually tested in solutions employing the following formulation:

FORMULATION

| Component | Wt. % |
|---|---|
| Ethylene glycol | 90.9273 |
| Boric acid | 0.4048 |
| 75% $H_3PO_4$ | 1.6877 |
| 45% KOH | 3.8802 |
| Total wt. % | 96.00 |

To the above formulation was added the individual acid grafted copolymer in an amount as specified in Table II below. Additional ethylene glycol was then added to the formulation as required to provide 100 wt. percent of a concentrate.

The concentrates were diluted to make working solutions by mixing 33 wt. % of concentrate with 67 wt. % of "corrosive water" (deionized water containing 300 ppm. each of $SO_4^{--}$, $HCO_3^-$ and $CL^-$, all added as the Na salts).

B. Laboratory Disc Heat Flux Test: Method, Apparatus and Results

A test method used in the industry was employed to determine the inhibitory effect of the formulated composition of the present invention with respect to heat rejecting aluminum surfaces. This test method is described in Corrosion, 15 257t at 258t (1959) "Laboratory Methods for Determining Corrosion Rates Under Heat Flux Conditions" and also in an ASTM textbook entitled, "Engine Coolant Testing: State of the Art", A Symposium Sponsored by ASTM Committee D-15, at pages 17–19 (Printed, May 1980), both incorporated herein by reference. A summary of the test equipment and procedure follows:

The apparatus consists of a 1 liter flask, fitted with a condenser, a thermometer, a temperature controller a $1\frac{1}{2}$ inch diameter$\times\frac{1}{4}$ inch thick No. 319 aluminum casting alloy (herein "the aluminum disc"), and a soldering iron heat source.

The apparatus was charged with 750 ml. of test solution and heated to effect boiling at the aluminum disc surface and to maintain a solution temperature of 85° C. The test duration was 168 hours. The weight loss of aluminum from the aluminum disc was determined and used as a measure of corrosion inhibitor effectiveness.

The results are given in Table II which follows:

TABLE II

| Working Solution Containing Grafted Copolymer | Wt. % Grafted Copolymer in Concentrate | Wt. % Grafted Copolymer in Working Solution | Al wt. loss (mg.) |
|---|---|---|---|
| A | 0.15 | 0.05 | 255 |
| A | 0.33 | 0.11 | 117 |
| A | 0.75 | 0.25 | 128 |
| B | 0.75 | 0.25 | 108 |
| C | 0.75 | 0.25 | 122 |
| D | 0.75 | 0.25 | 79 |
| E | 0.75 | 0.25 | 169 |
| — (Comparison I)[1] | No graft[1] | No graft[1] | 320 |
| — (Control)[2] | None[2] | None[2] | 231 |

[1]Comparison I contained no graft copolymer, but instead contained in the concentrate 0.675 wt. % of the base polymer used to prepare Grafted Copolymer D together with 0.075 wt. % of polyacrylic acid having a MW of 5000 in the above specified "Formulation".
[2]Base Formulation containing no graft or other polymer.

We claim:

1. An aluminum corrosion inhibitor composition concentrate comprising;

(a) an alcohol or mixtures of water and alcohol, and (b) a polymerizable-acid graft copolymer comprising an unsaturated grafting acid and having a percent acid graft of between about 1% and 60% and a base polymer consisting of a poly(oxyalkylene) compound of the formula: $R''(OC_nH_{2n})_zOR')_a$ wherein R′ and R″ are members selected from the group consisting of a hydrocarbon radical, a hydrogen atom or an acyl radical, a is an integer having a value of 1 to about 4, n has a value of 2 to 4 inclusive, z is an integer having a value of from 4 to 800 inclusive, said base polymer having a molecular weight of between about 200 and about 10,000, and wherein the amount of component (b) is between greater than about 0.05 wt. % and about 20 wt. % based on the total amount of component (a) plus component (b) in said concentrate.

2. The concentrate of claim 1 to which additionally is added:

(c) ammonium hydroxide, alkali metal hydroxides, or alkaline earth metal hydroxides; or amines of the formula

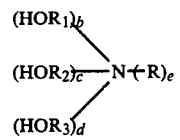

wherein R is hydrogen or alkyl having 1 to about 6 carbon atoms, each of $R_1$, $R_2$, and $R_3$ is an alkylene radical having 2 to 4 carbon atoms, e has a value of 0, 1, 2 or 3 and b, c, and d each have a value of 0 or 1 with the proviso that when b, c and d each have a value of 1, then e is 0.

3. The concentrate of claim 2 wherein component (c) is sodium or potassium hydroxide.

4. The concentrate of claim 1 wherein component (b) is soluble in component (a) to the extent of at least about 0.01 weight percent based on the weight of the concentrate.

5. The concentrate of claim 4 wherein component (a) is ethylene glycol.

6. The concentrate of claim 2 wherein the reaction product of component (b) and component (c) is soluble in component (a) to the extent of at least about 0.01 weight percent based on the weight of the concentrate.

7. The concentrate of claim 2 wherein the reaction product of component (b) and component (c) is insoluble in component (a).

8. The concentrate of claim 1 wherein component (b) is insoluble in component (a).

9. The concentrate of claim 4 wherein component (a) is ethylene glycol, said base polymer is a poly(oxyethylene-oxypropylene) compound having a molecular weight between 500 and 5,000, component (c) is sodium hydroxide, and said percent graft is between about 5% and about 20%.

10. The concentrate of claim 1 wherein component (b) is wholly or partially neutralized with a base.

11. An aluminum corrosion inhibitor composition comprising:

(a) alcohol or mixtures of water and alcohol, and (b) a polymerizable-acid graft copolymer comprising an unsaturated grafting acid and having a percent acid graft of between about 1% and 60% and a base polymer consisting of a poly(oxyalkylene) compound of the formula: $R''((OC_nH_{2n})_zOR')_a$ wherein R′ and R″ are members selected from the group consisting of a hydrocarbon radical, a hydrogen atom or an acyl radical, a is an integer having a value of 1 to about 4, n has a value of 2 to 4 inclusive, z is an integer having a value of from 4 to 800 inclusive, and preferably 8 to about 500, said base polymer having a molecular weight of between about 200 and about 10,000, and wherein the amount of component (b) is between greater than about 0.05 wt. % and about 15 wt. % based on the total amount of component (a) plus component (b) in said composition.

12. The composition of claim 11 to which additionally is added:

(c) ammonium hydroxide, alkali metal hydroxides, or alkaline earth metal hydroxides; or amines of the formula:

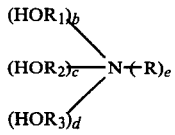

wherein R is hydrogen or alkyl having 1 to about 4 carbon atoms, each of $R_1$, $R_2$, and $R_3$ is an alkylene radical having 2 to 4 carbon atoms, e has a value of 0, 1 or 2 or 3 and b, c, and d each have a value of 0 or 1 with the proviso that when b, c, and d each have a value of 1, then e is 0.

13. The composition of claim 12 wherein component (c) is sodium or potassium hydroxide.

14. The composition of claim 11 wherein component (b) is soluble in component (a) to the extent at least about 0.01 weight percent based on the weight of the composition.

15. The composition of claim 14 wherein component (a) is ethylene glycol.

16. The composition of claim 12 wherein the reaction product of component (b) and component (c) is soluble in component (a) to the extent of at least about 0.01 weight percent based on the weight of the composition.

17. The composition of claim 12 wherein the reaction product of component (b) and component (c) is insoluble in component (b).

18. The composition of claim 11 wherein component (b) is insoluble in component (a).

19. The composition of claim 14 wherein component (a) is ethylene glycol, component (c) is sodium hydroxide, said base polymer is a poly(oxyethylene-oxypropylene) compound having a molecular weight between 500 and 5,000, and said percent graft is between about 5% and about 20%.

20. The composition of claim 11 wherein component (b) is wholly or partially neutralized with a base.

21. A method for providing aluminum-corrosion inhibition in an aluminum component heat transfer system which comprises filling said system with a composition comprising:

(a) alcohol or water or mixtures thereof, and (b) a polymerizable-acid graft copolymer comprising an unsaturated grafting acid and having a percent acid graft of between about 1% and 60% and a base polymer consisting of a poly(oxyalkylene) compound of the formula: $R''((OC_nH_{2n})_zOR')_a$ wherein R' and R'' are members selected from the group consisting of a hydrocarbon radical, a hydrogen atom or an acyl radical, a is an integer having a value of 1 to about 4, n has a value of 2 to 4 inclusive, z is an integer having a value of from 4 to 800 inclusive, and preferably 8 to about 500, said base polymer having a molecular weight of between about 200 and about 10,000, and wherein the amount of component (b) is between about 0.05 wt. % and about 15 wt. % based on the total amount of component (a) plus component (b) in said composition.

22. The method of claim 21 which comprises the additional step of adding to said composition:

(c) ammonium hydroxide, alkali metal hydroxides, or alkaline earth metal hydroxides; or amines of the formula:

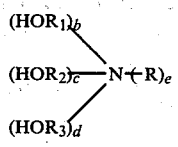

wherein R is hydrogen or alkyl having 1 to about 4 carbon atoms, each of $R_1$, $R_2$, and $R_3$ is alkylene radical having 2 to 4 carbon atoms, e has a value of 0, or 1, with the proviso that when b, c and d each have a value of 1, then e is 0.

23. The method of claim 22 wherein component (c) is sodium or potassium hydroxide.

24. The method of claim 21 wherein component (b) is soluble in component (a) to the extent at least about 0.01 weight percent based on the weight of the composition.

25. The method of claim 24 wherein component (a) is ethylene glycol.

26. The method of claim 22 wherein the reaction product of component (b) and component (c) is soluble in component (a) to the extent of at least about 0.01 weight percent based on the weight of the composition.

27. The method of claim 22 wherein the reaction product of component (b) and component (c) is insoluble in component (a).

28. The method of claim 21 wherein component (b) is insoluble in component (a).

29. The method of claim 24 wherein component (a) is ethylene glycol, component (c) is sodium hydroxide, said base polymer is a poly(oxyethylene-oxypropylene) compound having a molecular weight between 500 and 5,000, and said percent graft is between about 5% and about 20%.

30. The method of claim 21 wherein component (b) is wholly or partially neutralized with a base.

31. The method of claim 21 wherein said heat transfer system is a cooling system.

32. The concentrate of claim 1 wherein the amount of component (b) is between about 0.1 wt. % is based on the total amount of component (a) plus component (b) in said concentrate.

33. The composition of claim 11 wherein the amount of component (b) is between about 0.1 wt. % and about 15 wt. % is based on the total amount of component (a) plus component (b) in said composition.

34. The method of claim 21 wherein the amount of component (b) is between about 0.1 wt. % and about 15 wt. % is based on the total amount of component (a) plus component (b) in said composition.

* * * * *